US011203366B2

(12) United States Patent
Maisuradze

(10) Patent No.: US 11,203,366 B2
(45) Date of Patent: Dec. 21, 2021

(54) TRACK SWITCH

(71) Applicant: Temur Maisuradze, Tbilisi (GE)

(72) Inventor: Temur Maisuradze, Tbilisi (GE)

( * ) Notice: Subject to any disclaimer, the term of this patent is extended or adjusted under 35 U.S.C. 154(b) by 278 days.

(21) Appl. No.: 16/304,555

(22) PCT Filed: Feb. 6, 2017

(86) PCT No.: PCT/GE2017/000002
§ 371 (c)(1),
(2) Date: Nov. 26, 2018

(87) PCT Pub. No.: WO2017/203302
PCT Pub. Date: Nov. 30, 2017

(65) Prior Publication Data

US 2019/0291755 A1 Sep. 26, 2019

(30) Foreign Application Priority Data

May 24, 2016 (GE) ..... AP 2016 14154

(51) Int. Cl.
*B61L 5/10* (2006.01)
*E01B 7/00* (2006.01)
(Continued)

(52) U.S. Cl.
CPC ..... *B61L 5/10* (2013.01); *B61L 5/02* (2013.01); *B61L 5/026* (2013.01); *B61L 5/065* (2013.01);
(Continued)

(58) Field of Classification Search
CPC .... B61L 5/00; B61L 5/02; B61L 5/026; B61L 5/102; B61L 5/107; B61L 5/06;
(Continued)

(56) References Cited

U.S. PATENT DOCUMENTS 2,011,798 A 8/1935 Gallatin
3,737,658 A * 6/1973 Dohse ..... E01B 7/20 246/448
(Continued)

OTHER PUBLICATIONS

International Search Report of PCT/GE2017/000002, dated May 31, 2017.

*Primary Examiner* — Zachary L Kuhfuss
*Assistant Examiner* — Cheng Lin
(74) *Attorney, Agent, or Firm* — Cislo & Thomas, LLP

(57) ABSTRACT

A track switch that comprises track rails of basic (2), (3), straight, (4), (5) and lateral (6), (7) directions fastened on a slab track (1); sliding switch rails (8); (9) and point rails (10), (11) that are rigidly fastened to the slab track (1) by means of mounting means (12). The point rails and switch rails form points. The track switch comprises also a shift mechanism with a drive (14) and an axis (15), whereto sliding locks (16), (17) are connected. The point rails (10), (11) and the switch rails (8), (9) are connected with each other by means of units. Each of the units is a guide (18) that is rigidly fastened to the point rail, a wedge (19) that is rigidly fastened to the switch rail (8), (9), a cleat wedge (20) placed in the guides that is capable of moving longitudinally and fastened with its both ends to point rods (21) of the wedge (see FIGS. 1 and 4). The sliding wedges (20) are connected to each other by means of point rods (21), the last of the point rods being connected with the axis of the shift mechanism that is capable of rotating or moving longitudinally, and is set into motion by a shift drive mechanism. The sliding switch rails (8), (9) are connected to each other by means of spacing rods (22).

4 Claims, 2 Drawing Sheets

(51) Int. Cl.

| | |
|---|---|
| ***B61L 5/02*** | (2006.01) |
| ***E01B 7/08*** | (2006.01) |
| ***E01B 7/06*** | (2006.01) |
| ***B61L 5/06*** | (2006.01) |
| *E01B 7/02* | (2006.01) |

(52) U.S. Cl.
CPC ..... *E01B 7/00* (2013.01); *E01B 7/06* (2013.01); *E01B 7/08* (2013.01); *E01B 7/02* (2013.01)

(58) Field of Classification Search
CPC ... B61L 5/065; E01B 7/00; E01B 7/02; E01B 7/04; E01B 7/06; E01B 7/08
USPC ..... 246/415 R, 430, 442, 453
See application file for complete search history.

(56) References Cited

U.S. PATENT DOCUMENTS 4,927,102 A * 5/1990 Durchschlag ..... E01B 7/08 246/469
4,982,919 A * 1/1991 Durchschlag ..... B61L 5/02 246/382
5,207,401 A * 5/1993 Testart ..... E01B 25/28 246/442
6,616,105 B2 * 9/2003 Grunwald ..... B61L 5/10 246/430
8,608,115 B2 * 12/2013 Ruetzel ..... E01B 7/02 246/453

* cited by examiner

TRACK SWITCH

CROSS-REFERENCE TO RELATED APPLICATIONS

This United States Non-Provisional Patent Application claims priority to PCI Application No. PCT/GE2017/000002, titled "Track Switch," filed Feb. 6, 2017, which claims priority to Georgian Patent Application No. AP 2016 14154, titled "Point Switch," filed May 24, 2016, the contents of both applications are incorporated by reference herein in their entirety.

BACKGROUND

Track switches [1] are known that comprise frogs with movable tongues, and a pair of points placed on baseplates that are provided with curvilinear and straight point rails and are set into motion by means of point operating gears between main and lateral tracks.

Also known is a track switch [2] comprising a pair of points fastened on a slab track that are linked to the rails of main and lateral tracks; lock pins of a rail; a reverse gear with a drive and an axis disposed between swing rails of traction and means for their motion.

Movable peaky elements (contact tongues) of the conventional track switches are relatively less strong against external influences because they are subjected to intense wear that leads to limiting the speed of a rolling stock. The construction is not protected from intrusion of solid materials, snow, or ice within the spacing's between movable and immobile elements, which leads to incapacitation of a track switch.

As concerns movable non-peaky elements, they are stubborn and unstable, and are inadmissible for use at higher speeds. Therefore; such elements are used only on in-house tracks.

SUMMARY

The present invention is directed to a track switch that comprises a pair of points with sliding switch rails that is mounted on a slab track and connected with rails of basic, straight and lateral tracks, rail restrainers, a shift mechanism with a drive and an axis, and rods that are laid between said sliding switch rails of said points.

The invention is characterized in that a sliding switch rail of each said point is fastened between point rails and are connected therewith by means of units, and locks that are connected with said axis of said shift mechanism and disposed at junctions of switch rails with tracks of straight and lateral directions for ensuring the locking of the switch rails.

Each said unit provides connection between the point rails and switch rails comprises a guide that is rigidly fastened to the point rail, a sliding wedge placed in the guide that is capable of moving longitudinally and rigidly fastened with its both ends to point rods, and a wedge rigidly fastened to the switch rail that is rested upon said sliding wedge.

Said sliding wedges are connected to one another by means of point rods, the last of the point rods being connected with the axis of said shift mechanism.

DRAWINGS

These and other features, aspects, and advantages of the present invention will become better understood with regard to the following description, appended claims, and accompanying drawings.

DESCRIPTION

The present invention relates to railway construction industry, and more particularly to constructions that ensure joining and crossing of railway tracks.

The technical effect of the present invention is improved durability and reliability of a track switch as well as higher speed of a rolling stock.

The technical effect is achieved by that each point of a track switch is made in the form of point and swing rails connected with one another by means of some units, wherein each unit comprises a guide rigidly fastened to the point rail; a sliding wedge placed in the guide that is capable of moving in longitudinal direction and fastened with both ends to point rods, by means of which the mentioned sliding wedges are capable of moving in longitudinal direction between the wedges rigidly fastened to a rail and guides that are rigidly fastened to the point rail. The swing rails are joined by means of spacing rods. The wedges are connected to each other by means of point rods, the last point rod being connected to an axis laid under the rails and capable of rotating or moving longitudinally and, in turn, being connected with shift mechanism and movable locks.

The track switch according to the present invention is illustrated in four figures.

Figure 1:
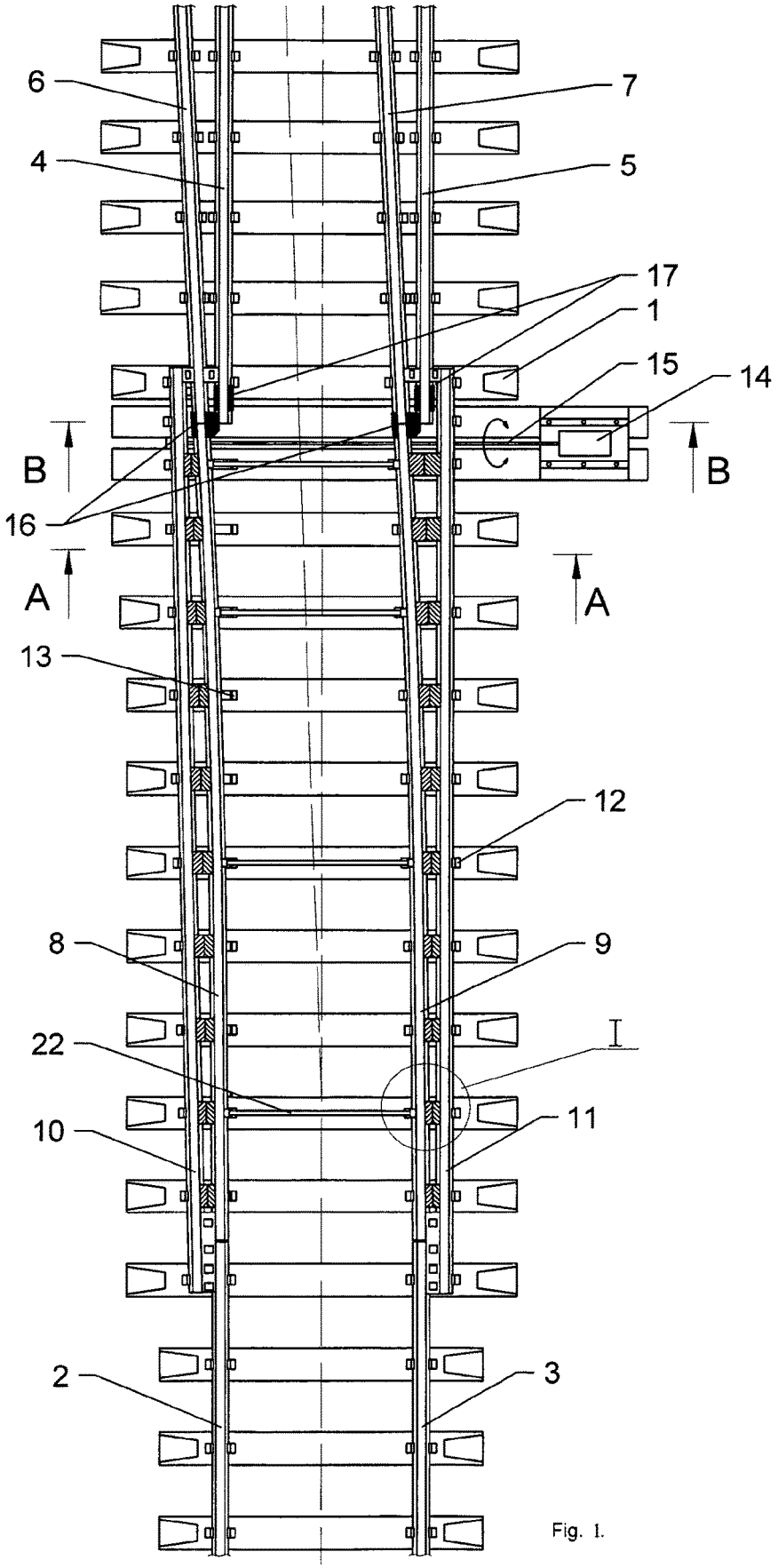
FIG. 1 depicts the top view of the track switch.
Figure 3:
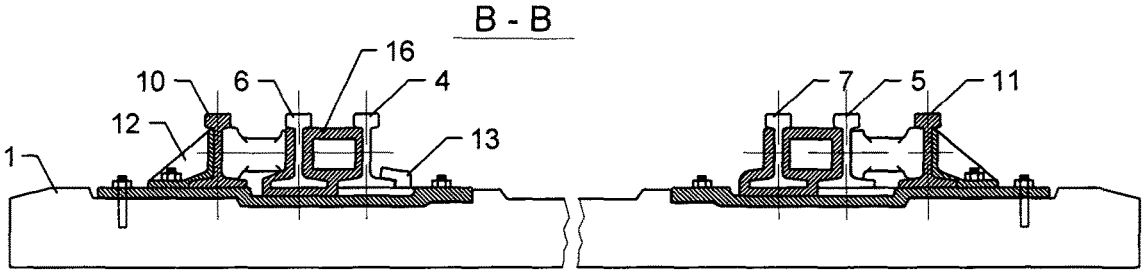
FIG. 3 illustrates the cross section B-B of that shown in FIG. 1.
Figure 2:
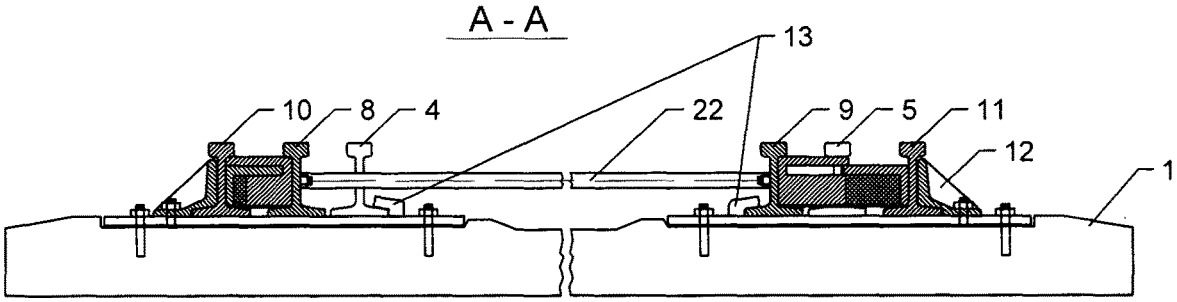
FIG. 2 illustrates the cross section A-A of that shown in FIG. 1.
Figure 4:
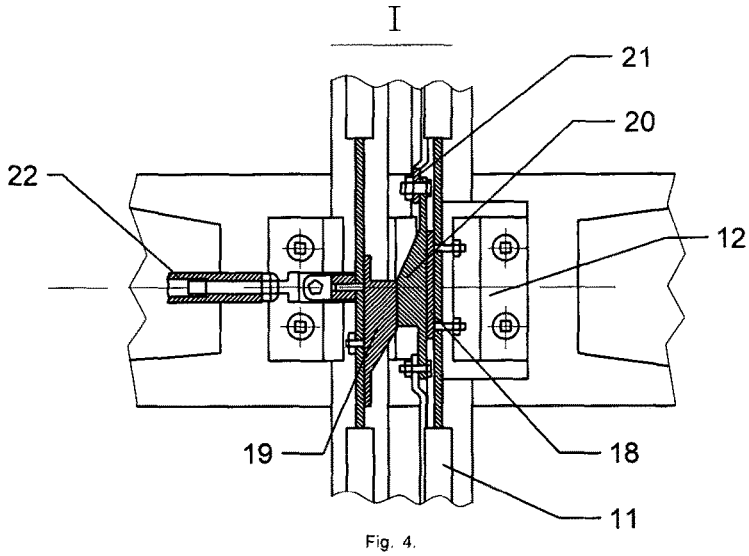
FIG. 4 depicts the top view of a unit that joins the point rail with the swing rail.

The track switch shown in FIGS. 1 to 3 comprises track rails of basic 2, 3, straight 4, 5 and lateral directions that are mounted on a slab track, sliding switch rails 8, 9 and point rails 10, 11 rigidly mounted on the slab track 1 by means of a mounting means 12. The point rails and switch rails form points. The point rails of the track switch are rigidly fastened with their one end to the ends of basic direction rails 2, 3, and with their another ends to the ends of straight 4, 5 and lateral 6, 7 direction rails, forming an integrated rigid frame. The switch rails 8, 9 of the track switch are rigidly fastened with their one ends to the point rails and are coupled with the basic direction rails 2, 3, and another ends are capable of moving between the point rails on restrainers 13 having sliding surface (made, for example, of fluorine plastic or similar composite material) and fastened on the slab track 1 for ensuring fixation of the switch rails in extreme points. The track switch comprises also a shift mechanism with drive 14 and axis 15 capable of being rotated and moved in horizontal direction, whereto movable locks 16, 17 are connected that are disposed in places of joining the switch rails 8, 9 with straight 4, 5 and lateral 6, 7 direction tracks for ensuring the fixation of the switch rails. In addition, the point rails 10, 11 and switch rails 8, 9 are connected to each other by means of units (see FIG. 4). Each unit comprises a guide 18 rigidly fastened to the point rail, a wedge 19 rigidly fastened to the switch rail 8, 9, sliding cleat wedge 20 placed in the guide and capable of moving longitudinally, supported on a fixed wedge and fastened with both ends to the point rods 21 (see FIGS. 1 and 4). The cleat wedges 20 are connected to each other by means of point rods, and the last point rod in points of arrangement of locks is connected to the axis 15 of the shift mechanism being capable of rotating or moving in horizontal direction, set into motion by the switch drive 14. The sliding switch rails 8, 9 are connected to each other by means of spacing rods 22.

The device operates in the following manner: in order to shift a rolling stock from basic track 2, 3 to the lateral track 6, 7, the axis 15 moves the locks 16 by the drive 14 until the switch rails 8,9 have been disconnected from the straight track 4, 5 (or vice versa) (see FIGS. 1 and 3). As soon as the axis is set into the action, the point rods 21 start operating which, in turn, leads to the motion of the sliding cleat wedges 20, and, accordingly, to the production of a spacing force. When the cleat wedge 20 between the switch rail 9 and the fixed point rail 11, acting with the spacing force with the aid of rods, presses on the sliding switch rail 8, the cleat wedge 20 is synchronously disengaged between this sliding switch rail 8 and the fixed point rail 10, whereby it acts just as a support for the switch rail 8 on the point rail 10 (see FIGS. 1, 2, and 4). The sliding switch rails 8, 9 via spacing forces produced between the wedged and by the point rods 21 are synchronously moved on the restrainers 13 having sliding surfaces and are fixed in the extreme points. Next, the locks 17 disposed close to the lateral direction rails 6, 7, which are rigidly fastened to the fixed point rails 10 and 11, lock the switch rails 8, 9 being radiuses as required. In this position, the switch rails are rigidly fixed in horizontal and vertical planes.

Shifting from the lateral track to the basic one is accomplished in inversed order.

The present invention ensures reliable operation of a switch track and reduces wearing of its component parts, excludes accidental intrusion of external items in the switch construction, and the stable fixation of the point improves the motion safety, ensures rolling stock safety and motion thereof at a higher speed.

The invention claimed is:

1. A track switch for use in a railway track comprising a pair of basic direction rails, a pair of straight direction rails and a pair of lateral direction rails, the track switch comprising:

a) a pair of points with sliding switch rails that is mounted on a slab track and connected with the rails of basic, straight and lateral tracks;

b) at least two rail restrainers;

c) a shift mechanism with a drive and an axis;

d) at least two rods that are laid between said sliding switch rails of said points;

e) a pair of point rails mounted on the slab track outside the pair of basic direction rails, the pair of straight direction rails, and the pair of lateral direction rails, in longitudinal alignment with the pair of basic rails and the pair of straight rails, each point rail having an inner side surface that faces an outer side surface of the corresponding railway track rail;

wherein the pair of point rails each have one end rigidly fastened to one end of the pair of basic direction rails, and an other end of the pair of point rails is rigidly fastened to an end of the pair of straight rails and an end of the pair of lateral direction rails, thereby forming a rigid frame integrated with straight and lateral tracks in the longitudinal, transverse and vertical planes;

wherein the pair of point rails are connected with the sliding switch rails by means of connection units so one end of the sliding switch rails is movable between the ends of straight and lateral direction rails.

2. The track switch in accordance with claim 1, wherein each said unit provides connection between the pair of point rails and the pair of sliding switch rails and comprises:

a) a guide that is rigidly fastened to one of the pair of point rails;

b) a sliding wedge placed in the guide that is capable of moving longitudinally and rigidly fastened with both ends of the sliding wedge to point rods;

c) a wedge rigidly fastened to one of the sliding switch rails that is rested upon said sliding wedge;

wherein a plurality of sliding wedges are connected to one another by means of point rods, the last of the point rods being connected with the axis of said shift mechanism.

3. The track switch in accordance with claim 2, further comprising locks that are connected with said axis of said shift mechanism and disposed at junctions of the sliding switch rails and the straight and lateral direction rails for ensuring the locking of the sliding switch rails.

4. A railway track switch system for use with a pair of point rails that are positioned with at least a portion of a pair of basic rails, at least a portion of a pair of straight rails, at least a portion of a pair of lateral direction rails, and at least a portion of a pair of sliding switch rails between the pair of point rails, the switch comprising:

a) a shift mechanism having a drive and an axis, the axis capable of being rotated and moved in horizontal direction relative to a ground surface;

b) at least two pairs of movable locks configured to couple to one end of the pair of sliding rails, one end of the pair of straight rails, and one end of the pair of lateral direction rails;

c) at least one pair of switch units, each unit comprising:

i) a guide configured to rigidly fasten to one of the pair of point rails;

ii) a wedge configured to rigidly fasten to one of the pair of sliding switch rails;

iii) a sliding cleat wedge configured for positioning within the guide and capable of moving longitudinally with respect to the rails; and iv) at least one point rod configured to couple to the sliding cleat wedge; and d) at least one spacing rod configured to couple the pair of sliding switch rails to each other.

* * * * *